United States Patent [19]

D'Annunzio

[11] Patent Number: 4,753,087

[45] Date of Patent: Jun. 28, 1988

[54] ADJUSTABLE RING STRUCTURE

[76] Inventor: Philip D'Annunzio, 3506 Lufberry Ave., Wantagh, Long Island City, N.Y. 11793

[21] Appl. No.: 42,742

[22] Filed: Apr. 27, 1987

Related U.S. Application Data

[62] Division of Ser. No. 796,798, Nov. 12, 1985, Pat. No. 4,697,437.

[51] Int. Cl.[4] ..... A44C 9/02

[52] U.S. Cl. ..... 63/15.45; 63/15.5

[58] Field of Search ..... 63/15, 15.45, 15.5, 63/15.6, 15.65, 15.7, 26, 29 R, 30

[56] References Cited

U.S. PATENT DOCUMENTS

| | | | |
|---|---|---|---|
| 263,920 | 9/1882 | La Grange | 63/15.65 |
| 297,446 | 4/1884 | Prahl | 63/15.65 |
| 672,366 | 4/1901 | Herzog | 63/29 R |
| 738,700 | 9/1903 | Roitman et al. | 63/29 R |
| 899,296 | 9/1908 | Elliot | 63/29 R |
| 1,859,189 | 5/1932 | Wheeler | 63/26 X |
| 2,430,508 | 11/1947 | Holl | 63/15.5 X |
| 3,901,045 | 8/1975 | Ballester | 63/15.65 |

FOREIGN PATENT DOCUMENTS

| | | | |
|---|---|---|---|
| 63751 | 11/1982 | European Pat. Off. | 63/26 |
| 538591 | 11/1931 | Fed. Rep. of Germany | 63/29 R |

*Primary Examiner*—Kenneth J. Dorner
*Assistant Examiner*—James R. Brittain
*Attorney, Agent, or Firm*—Marvin S. Gittes

[57] ABSTRACT

Adjustable ring structure is provided in accordance with the teachings of the present invention wherein a ring shank is hinged to define first and second arcuate elements having an aperture therebetween. According to one preferred embodiment, a ring top having first and second slider members is disposed within the opening with the first and second slider members slideably mounted within interior groove portions in each of the first and second arcuate elements. First and second arms are provided for connecting the ring top to corresponding locations on the first and second arcuate elements adjacent to the opening to allow the ring top to be displaced to expand and contract the ring shank while an overall round configuration is maintained. In a second preferred embodiment, a minor ring segment having a pair of externally groove sidewalls is provided in conjunction with a linkage pivotably connecting the minor ring segment to the first and second arcuate elements at a location thereon proximate to the opening to allow the minor ring segment to be displaced toward and away from the opening to expand and contract the ring shank. An ornamental ring top configured to fit over the minor ring segment and at least portions of the first and second arcuate elements is provided with a pair of internally grooved sidewalls positioned to spatially cooperate with the pair of externally grooved sidewalls in the minor ring segment to define a pair of closed channels.

5 Claims, 3 Drawing Sheets

ADJUSTABLE RING STRUCTURE

This is a division of application Ser. No. 796,798, filed Nov. 12, 1985, now U.S. Pat. No. 4,697,437.

BACKGROUND OF THE INVENTION

This invention relates to adjustable ring structure and more particularly to ring structure which is expandable by a wearer for purposes of fit or the like while the same readily maintains an overall round cross-sectional configuration independent of the degree of expansion imposed.

The sizing requirement which attends most purchases of finger rings has always been viewed with distain by purchasers and sellers of jewelry alike. In the case of the purchaser, a waiting requirement and a return trip to the seller prior to physically acquiring the finger ring is generally considered to be an inconvenience. From the standpoint of the seller, sizing requires that the goods purchased either be sent to another location for sizing or the retailer himself maintain both tools and competent personnel at the retail location to perform this service. In addition, once a ring is properly sized it is not infrequent that expansion or contraction of the finger upon which the ring is worn, associated with the weather or the like, render an initial fitting imperfect or at least periodically imperfect.

Finger rings which employ ring shanks of fixed size do not accommodate current trends toward wearing several finger rings at one time and the attendant desire by many wearers to periodically change the finger upon which a particular ring is worn. Such rings also do not readily accommodate wearers whose finger joints are enlarged or periodically become enlarged due to arthritis or the like, since if such rings comfortably fit over the inflamed joint, they will not properly fit the appropriate finger location therefor. Conversely, if the same properly fits the appropriate finger location, it cannot be readily removed from the finger over an inflamed joint.

While the need for adjustable ring structure has long been recognized, proposed solutions generally exhibit one or more common disadvantages which have prevented wide acceptance. Most commonly, adjustable rings proposed by the prior art have exposed or partially exposed mechanisms which prevent the resulting finger ring structure from having the appearance of fine jewelry. In cases where the look of fine jewelry is retained, it is often found that the adjustment available for a given ring may be limited to approximately one-half of a size, making it necessary for the jewelry seller to maintain either a large stock of variously sized rings or requiring some sizing to take place despite the fact that an adjustable ring is being purchased. In cases where substantial adjustability is available, the resulting adjustable ring structure is frequently such that as the ring expands the same looses its classic round shape and thus acquires a disfigured or distended appearance. Finally, in many cases where substantial adjustment is available such adjustment must be implemented by a skilled jeweler, thus removing many of the attributes of an adjustable ring for a purchaser.

Therefore, it is a principal object of the present invention to provide adjustable ring structure which retains the appearance of fine jewelry.

A further object of this invention is to provide adjustable ring structure which admits of substantial adjustment in size.

An additional object of the present invention is to provide adjustable ring structure which retains an overall round ring configuration regardless of the degree of expansion imposed.

A further object of the present invention is to provide ring structure whose sizing is readily adjustable by the user.

An additional object of the present invention is to provide self-adjusting ring structure wherein an expansion in sizing is readily implemented by a wearer while such structure is biased towards a contracted condition so that a proper fit of the ring in an appropriate position on the finger is obtained even though expansion to place the ring over a joint may have been necessary.

Various other objects and advantages of the present invention will become clear from the following detailed description of several exemplary embodiments thereof and the novel features shall be particularly pointed out in conjunction with the claims appended hereto.

SUMMARY OF THE INVENTION

In accordance with the teachings of the present invention, adjustable ring structure is provided wherein a ring shank is hinged to define first and second arcuate elements having an aperture therebetween. According to one preferred embodiment of the invention, a ring top having first and second slider members affixed thereto is disposed within said opening in a manner such that the first and second slider members are slideably mounted within interior groove portions in each of the first and second arcuate elements to dispose the ring top in said opening. First and second arms are provided for connecting said ring top to corresponding locations on said first and second arcuate elements adjacent to said opening to allow said ring top to be displaced to expand and contract said ring shank while an overall round configuration is maintained.

According to a second preferred embodiment, a minor ring segment having a pair of externally grooved sidewalls is provided in conjunction with a linkage pivotably connecting the minor ring segment to the first and second arcuate elements at a location thereon proximate to said opening to allow said minor ring segment to be displaced toward and away from the opening to expand and contract the ring shank. An ornamental ring top configured to fit over said minor ring segment and at least portions of the first and second arcuate elements is provided with a pair of internally grooved sidewalls positioned to spatially cooperate with the pair of externally grooved sidewalls in the minor ring segment to define a pair of closed channels.

BRIEF DESCRIPTION OF THE INVENTION

The invention will be more clearly understood by reference to the following detailed description of several exemplary embodiments thereof in conjunction with the accompanying drawings in which.

DETAILED DESCRIPTION

Figure 1:
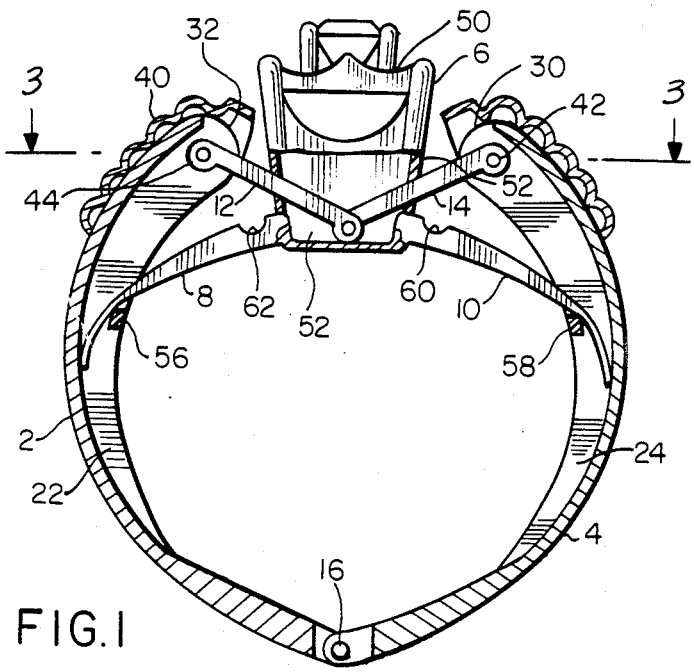
FIG. 1 is a front view, partially in section, of a preferred embodiment of an adjustable ring structure according to the present invention.
Figure 3:
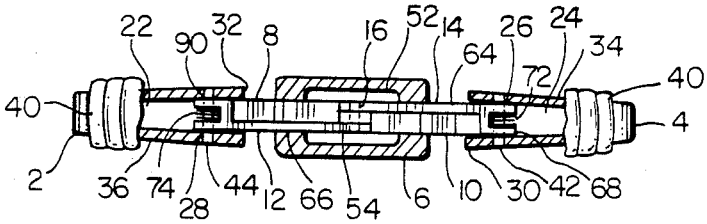
FIG. 3 is a top view, partially in section through 3—3 of the embodiment of the invention illustrated in FIG. 1.
Figure 2:
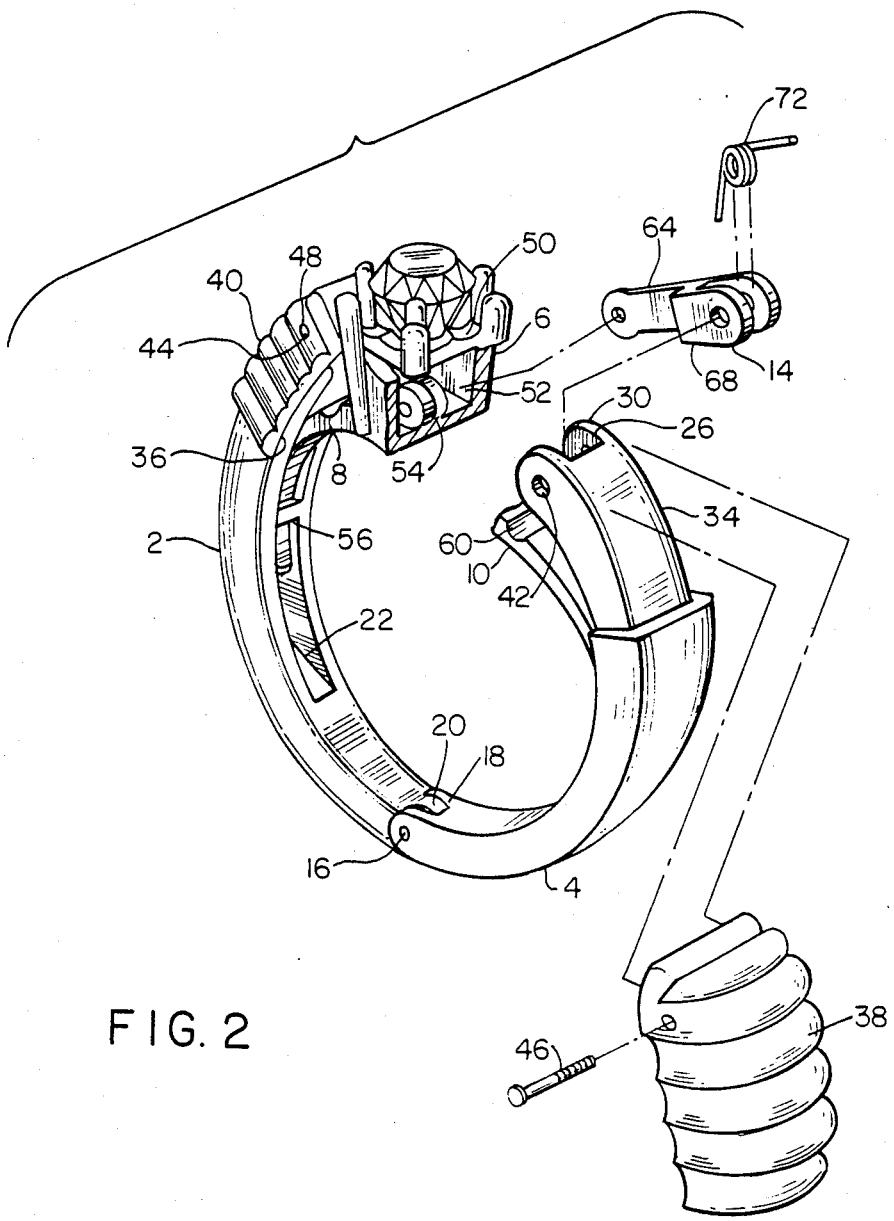
FIG. 2 is an exploded view, partially broken away, of the embodiment of this invention shown in FIG. 1.

Referring now to the drawings and more particularly to FIG. 1 thereof, there is shown a front view, partially in section, of a preferred embodiment of an adjustable ring structure according to the present invention. The preferred embodiment of the adjustable ring structure illustrated in FIG. 1 comprises first and second arcuate members 2 and 4 forming a ring shank, a ring top 6 having first and second arcuate slider members 8 and 10, and a pair of interconnecting arms 12 and 14. An exploded view, partially broken away, of this embodiment of this invention is illustrated in FIG. 2 while a top view thereof, partially in section through lines 3—3, is illustrated in FIG. 3. In the following discussion of the instant embodiment of the invention, FIGS. 2 and 3 should be consulted in additional to FIG. 1 since the structure of particular portions thereof may be best appreciated in conjunction with the several views set forth. Common reference numerals for commonly designated portions of the adjustable ring structure disclosed are used throughout FIGS. 1–3.

The first and second arcuate members 2 and 4 forming the ring shank are hinged at the bottom portion thereof by a pin member 16 disposed through each of the first and second arcuate members 2 and 4 in the manner best shown in FIGS. 1 and 2. As best shown in FIG. 2, each of the first and second arcuate members 2 and 4 are configured to be placed in a hinged or pivoted relationship by the provision within arcuate member 4 of a groove 18 contoured so as to accept a curved tongue 20 formed on the first arcuate member 2. The portions of the first and second arcuate members 2 and 4 surrounding the tongue 20 and the groove 18 are also formed, as plainly indicated in FIG. 2, in complimentary arcuate configurations to accept and allow rotation of the adjacent portion of the complimentary first and second arcuate members 2 and 4. In this manner once the pin or rivet member 16 is placed within the correspondingly located aperture in the tongue and grooved end portions of the first and second arcuate members 2 and 4, the first and second arcuate members 2 and 4 forming the ring shank are freely pivotable about pin 16 to readily increase the internal diameter of the ring shank in the manner best appreciated in connection with FIGS. 1 and 2. Those of ordinary skill in the art will readily appreciate that internal portions of the aperture cut in the second arcuate member 4 may be threaded to accept threads placed on an end portion of the pin member 16, in a manner well known to those of ordinary skill in the art. In this manner the pin 16 is locked in place and maintains a freely displaceable relationship between the first and second arcuate members 2 and 4 forming the ring shank. When the pin 16 thus takes the form of a screw, a portion of the aperture within the second arcuate member 4 may be countersunk to accept the head thereof, and hence, maintain an appropriate appearance for the ring shank formed.

Each of the first and second arcuate members 2 and 4 is provided with internal arcuate grooves 22 and 24 beginning, as best shown in FIGS. 1 and 2, approximately one-third of the arcuate length thereof up from the end portion of the first and second arcuate members 2 and 4 placed in a hinged relationship by the pin 16. The arcuate grooves 22 and 24, as plainly shown in FIGS. 1 and 2, extend completely to the other end portion of the first and second arcuate members 2 and 4. The function of the arcuate grooves 22 and 24, as shall be seen below, is to accept the slider members 8 and 10 on the ring top 6 and hence increase or decrease the displacement in the inner diameter of the ring shank as a function of the vertical position of the ring top 6.

The end portions of the first and second arcuate members 2 and 4 opposite to the hinged end portion thereof are cut away, in the manner best shown in FIGS. 2 and 3, to form grooves 26 and 28 which are extensions of the internal grooves 22 and 24 for the purposes of accepting a tongue. The end walls 30 and 32 surrounding the grooves 26 and 28 are again rounded in the manner best shown in FIGS. 1 and 2 and the entire end portions 34 and 36 of the first and second arcuate members 2 and 4 are cut away to accept ornamental covers 38 and 40. The ornamental covers 38 and 40 provide, as shall be seen below, an ornamental covering for the mechanism of the adjustable ring structure disclosed herein. The end portions 34 and 36 are provided with apertures 42 and 44 for providing, as shall be seen below, pivotable connections for the arms 12 and 14 as well as a means for interlocking the ornamental covers 38 and 40 to the first and second arcuate members 2 and 4 by means of screw means 46 and 48. Obviously, although screw means are specifically noted, a rivet or other frictionally engaging means may be used as well.

The ring top 6 takes the form of a hollowed ornamental member from which first and second arcuate slider members 8 and 10 extend in the manner shown in FIGS. 1–3. The top portion of the ring top 6 is shown as configured with a setting platform 50 and prongs to accept an ornamental stone which may be precious, semi-precious or otherwise, but obviously ornamentation in precious metal or otherwise may replace the setting platform 50.

The setting platform 50 is mounted at the top of the ring top 6 and covers a hollowed out interior portion 52 thereof. In FIGS. 1–3 the walls of the ring top 6 extending towards the side of the ring are ornamental and serve to hide portions of the adjusting mechanism of the instant invention. The side walls facing the end portions 34 and 36 of the first and second arcuate members 2 and 4 are opened for purposes of accepting the pair of arms 12 and 14. A mounting ring 54, for purposes of providing a mounting platform for interconnecting arms 12 and 14 to the ring top 6, is affixed to the bottom of the hollowed out interior portion 52 of the ring top 6 in the manner best shown in FIG. 2. Extending from the bottom and side portions of the ring top 6 are the slider members 8 and 10 which may be formed integral with the ring top 6, or separately formed and soldered or otherwise joined thereto.

The slider members 8 and 10, as plainly illustrated in FIG. 2, have a width which is slightly less than the width of the internal arcuate grooves 22 and 24 so that when the same are mounted within these grooves in the manner best illustrated in FIGS. 1 and 2, the portions thereof closest to the ring top 6 may freely displace from the internal arcuate grooves 22 and 24 to maintain the internal cross-section of the ring formed in an overall circular configuration. As best shown in FIGS. 1 and 2, bars 56 and 58 are formed across the internal arcuate grooves 22 and 24 within the first and second arcuate members 2 and 4 to maintain at least end portions of the first and second slider means 8 and 10 within the internal grooves 22 and 24. Thus, the limits of expandability of the first and second arcuate members 2 and 4 are defined, as shall be seen below, by the vertical displacement of the ring top 6 permitted by the arms 12 and 14.

It should also be noted that the first and second arcuate slider members 8 and 10 are tapered in the manner best shown in FIG. 1 so that the portions thereof engaging the internal arcuate grooves 22 and 24 are highly flexible. This insures that a substantial portion thereof is maintained in the groove regardless of the vertical position of the ring top 6. The slider members 8 and 10 act as well to expand the internal diameter of the ring shank whenever the ring top 6 is upwardly displaced and allow the first and second arcuate members 2 and 4 to come closer together when the ring top 6 is downwardly displaced. The slider members 8 and 10 also act to provide resiliency concerning the adjustable expansion or contraction of the ring structure illustrated in FIG. 1. Each of the slider members 8 and 10 are provided with upwardly disposed grooves 60 and 62 so that when the ring illustrated in FIGS. 1–3 is in its fully expanded position, i.e., with the ring top 6 displaced in its full upward position, the grooves 60 and 62 will nest with portions of the arms 12 and 14 within grooves 26 and 28. In this manner further expansion of the adjustable ring may be limited by providing a positive stop.

The pair of arms 12 and 14 are each configured in the overall shape of a Y having straight arm portions 64 and 66 and an L-shaped portions 68 and 70 formed therein to form an upper member having a grooved section as the upper part of the Y. Both ends of each of the arms 12 and 14 are apertured in the manner illustrated in FIGS. 2 and 3 enabling the aperture in the straight arm portions 64 and 66 to be pinned to the mounting ring 54 within the hollowed out interior portion 52 of the ring top 6. The apertured Y section of the upper portion of each of the first and second arms 12 and 14 fits as a tongue within the grooves 26 and 28.

Clip springs 72 and 74, as best shown in FIGS. 2 and 3, are mounted within the groove formed in each of the arms 12 and 14 so that the apertures within each of the clip springs 72 and 74, the apertured Y portion of the pair of interconnected arms 12 and 14, the grooves 26 and 28 within the first and second arcuate members 2 and 4, and the apertures within the ornamental covers 38 and 40 will align and may be fixed mounted when the screw means 46 and 48 are inserted therein. When this occurs, the pair of arms 12 and 14 will be pivotably mounted at both ends and it should be noted that the bias provided by the clip springs 72 and 74 will, under these circumstances, bias the ring top 6 in its most downwardly extended position to thereby bias the adjustable ring means according to the instant invention in a contracted position. This means that when worn on a finger, or for that matter being placed on a finger by the wearer expanding the same to accommodate a knuckle or the like, the adjustable ring means according to the instant invention will be predisposed to contract to the smaller diameter of a finger portion once the same is disposed thereon. It should also be noted, as may best be seen in FIG. 3, that the pair of arms 12 and 14 are complimentary in shape so that the straight arm portions 64 and 66 reside on opposite sides of the mounting ring 54.

Once the embodiment of the adjustable ring structure illustrated in FIGS. 1–3 is assembled in the manner described above and shown in FIG. 2, the same will reside in its normally contracted position, as shown in FIG. 1, due to the bias imposed by the clip springs 72 and 74. However, expansion may be readily and easily accomplished by the user placing the ring on the tip of the finger and pulling up on the ring top 6. When the ring top 6 is pulled up it will be vertically displaced until a maximum condition of displacement is achieved when the grooves 60 and 62 nest against the bottom portion of the clip springs 72 and 74 and the bottom portion of the Y-shaped portion of the pair of arms 12 and 14. In this condition the first and second arcuate members 2 and 4 will pivot away from each other about the pin 16 so that the adjustable ring structure is in a maximum width condition while the overall round shape of the interior of the ring shank formed is maintained. This results due to the displacement of the arcuate members 8 and 10 as well as the first and second arcuate members 2 and 4. In this condition the adjustable ring structure may be easily displaced over a joint in a finger and brought to rest at the section on the finger where it is to be worn.

Once the ring top 6 is released the ring structure, acting under the bias of the clip springs 72 and 74, will contract to a size which will tightly fit the portion of the finger upon which it has been disposed. In this regard it should be noted that the biasing force selected for the clip springs 72 and 74 is preferably chosen so that the ring structure will snugly fit the portion of the finger on which it is disposed even if a user's hand is quite active and a relatively large stone is mounted in the ring top 6. However, bias force associated with the clip springs 72 and 74 is selected so that the same will never be uncomfortably tight.

In actual embodiments of the adjustable ring structure disclosed in FIGS. 1–3 which have been built and tested, it was found that size variations would readily vary over a three three size range while overall roundness of the internal ring configuration was retained. This insures comfort and satisfactory appearance. With such size variance as thus available, it should be noted that only three such rings would typically have to be maintained in inventory to insure that a dealer could fit any customer of a particular sex seeking to purchase the ring. This would markedly reduce inventory requirements and no requirement for sizing by the jeweler is present since the same is readily accomplished by the wearer. The resulting structure is quite pleasing in overall appearance and when mounted on a wearer's finger gives no impression that an adjustable structure is involved. It thus maintains the appearance of fine jewelry despite its adjustable nature.

While the instant embodiment of the invention has been disclosed in association with a ring top 6 employed to mount a precious, semi-precious or imitation stone, it will additionally be appreciated that other ornamental approaches to forming the ring top 6 with metal could be used as well. Similarly, ornamental covers 38 and 40 may be varied in look or shape to accommodate many tastes, and additional adjustability may be provided by changing the shape of arms 12 and 14 or by increasing the depth of the grooves 60 and 62. Those of ordinary skill in the art will readily appreciate that the external details of the embodiment of the invention illustrated in FIGS. 1–3 may be varied to a great extent to incorporate the external appearance a designer wishes to provide so long as the internal adjustment mechanism is permitted to function in the manner detailed above. Since the ring size of the instant embodiment of the present invention may be varied at will throughout a range of three sizes, the same will plainly accommodate applications where changes in finger size due to heat or humidity are contemplated. Similarly, conditions where swollen joints of a user or a desire on the part of a user to wear the ring at various locations may be accommodated as well.

Figure 6:
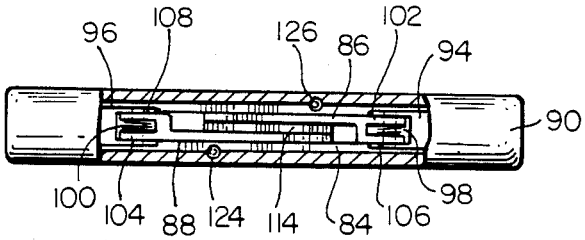
FIG. 6 is a top view, partially in section through 6—6, of the embodiment of the invention shown in FIG. 4.
Figure 5:
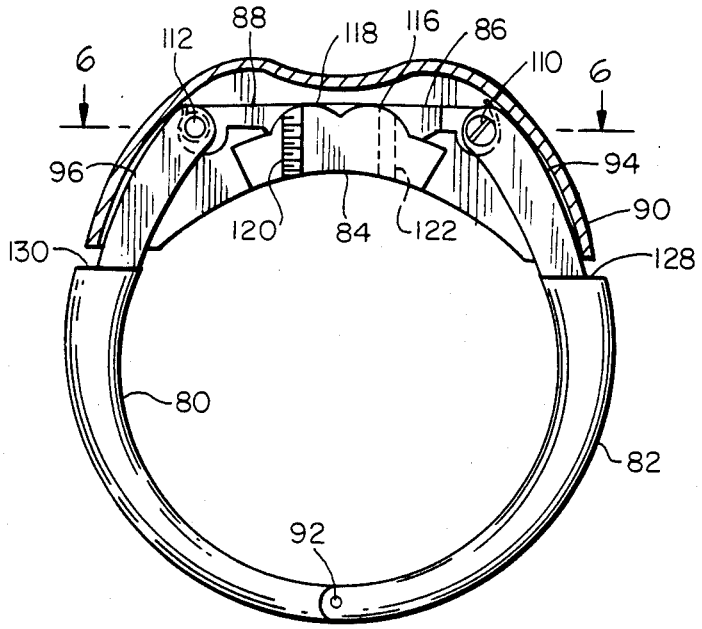
FIG. 5 is another front view of the embodiment of the adjustable ring structure shown in FIG. 4 illustrating such ring structure in an expanded position.
Figure 4:
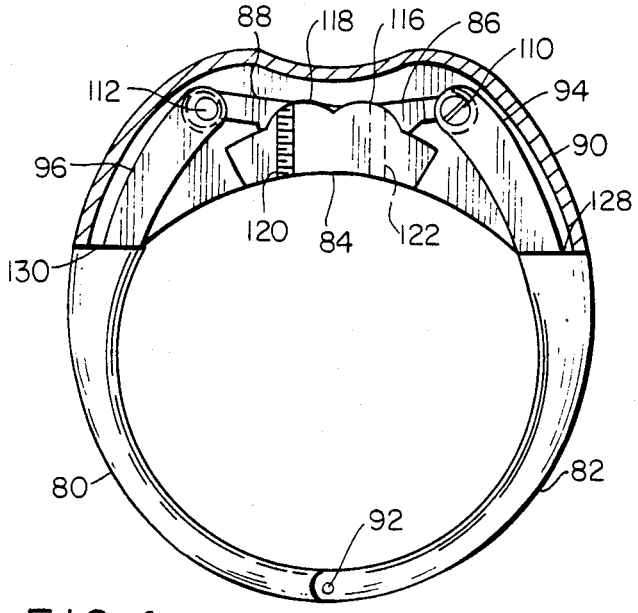
FIG. 4 is a front view, partially in section, of another embodiment of an adjustable ring structure according to the present invention illustrating such ring structure in a contracted position.

Referring now to FIG. 4 there is shown a front view, partially in section, of another preferred embodiment of the present invention wherein the illustrated ring structure is shown in a contracted position. The same embodiment of the invention as is illustrated in FIG. 4 is also shown in FIG. 5 in an expanded position, while FIG. 6 is a top view of the same embodiment where a partial section has been taken through section lines 6—6 in FIG. 5. The embodiment of the invention illustrated in FIGS. 4–6 is an improvement of expandable ring structure similar to that disclosed in U.S. Pat. No. 3,901,045 which issued to Gabriel Ballester on Aug. 26, 1975.

The embodiment of the adjustable ring structure illustrated in FIGS. 4–6 again comprises first and second arcuate members 80 and 82 forming a ring shank, an arcuate minor segment 84, a pair of interconnecting arms 86 and 88, and a ring top 90. The first and second arcuate members 80 and 82 are joined at a bottom location by means of a screw or rivet 92 in precisely the same manner that was described in association with the embodiment of this invention described in connection with FIGS. 1–3. The first and second arcuate members 80 and 82 preferably have their end sections, which are joined by the rivet 92, configured in precisely the same manner described in connection with FIG. 2 through a tongue and groove arrangement so that a pivoted or hinged relationship obtains and forms a hinged ring shank which is open at the top. In this manner the diameter of the interior of the ring shank formed by the first and second arcuate members 80 and 82 may be expanded or contracted by rotation of the first and second arcuate members 80 and 82 about the hinged location formed by rivet 92.

An arcuate minor segment 84, which is here relatively short, is disposed in a bridging relationship with the open end of the hinged shank formed by the first and second arcuate members 80 and 82. More particularly, first and second arcuate members 80 and 82 are cut away in precisely the same manner described in connection with FIG. 2 so that the peripheral portions thereof will accept the ring top 90. The end portions of the first and second arcuate members 80 and 82 form a groove for purposes of accepting clip springs 98 and 100, as best shown in FIG. 6, and grooved portions of the pair of arms 86 and 88. The clip springs 98 and 100 may take precisely the same form as the clip spring 72 illustrated in FIG. 2. Similarly, each of the pair of arms 86 and 88 are configured much in the same manner as the pair of arms 12 and 14 described in association with FIGS. 1–3 so as to include straight sections 102 and 104 and L-shaped sections 106 and 108 at one end thereof. The pair of arms 86 and 88 thus have a groove formed therein capable of accepting the clip springs 98 and 100. In addition, as was the case in connection with the embodiment of the invention illustrated in FIGS. 1–3, the pair of arms 86 and 88 are configured in a complimentary manner so that when mounted within the ring structure, as best shown in FIG. 6, the straight sections 102 and 104 are disposed towards opposite external surfaces of the ring structure.

The groove formed within the ends of each of the pair of arms 86 and 88 is drilled or apertured as are the end portions of the first and second arcuate members 80 and 82 so that, as best shown in FIG. 6, the clip springs 98 and 100 may be disposed within the grooved portions of the interconnecting arms 86 and 88 and axially aligned with the aperture formed. This portion of each of the interconnecting arms 86 and 88 may thus be disposed within the grooves formed in the end portions of the first and second arcuate members 80 and 82 and thereafter a rivet or screw may be disposed within the aperture 2 to pivotably mount each of the pair of interconnecting arms 86 and 88 to the first and second arcuate members 80 and 82 in such manner that the clip springs 98 and 100 will bias each of the interconnecting arms 86 and 88 in a downwardly displaced position.

The top of the arcuate minor segment 84 is provided with a pair of parallel grooves whose width is slightly greater than the width of each of the pair of interconnecting arms 86 and 88. Between the pair of parallel grooves formed in the top of the arcuate minor segment 84 is provided a mounting wall 114, as best shown in FIG. 6, which is apertured and threaded so as to accept a screw means or the like. The end of the straight sections 102 and 104 of each of the interconnecting arms 86 and 88 is enlarged and apertured in precisely the same manner as shown for the pair of interconnecting arms 12 and 14 in FIG. 2. In addition, the top portions of the arcuate minor segment 84 are preferably rounded at the locations indicated as 116 and 118 to correspond to the enlarged portions of the pair of interconnecting arms 86 and 88.

The mounting wall 114 and opposing enlarged portions 116 and 118 of the arcuate minor segment 84 are drilled and threaded in portions thereof so that screws or rivets, not shown, may be inserted through the end portions of each of the pair of interconnecting arms 86 and 88 to mount each of the interconnecting arms 86 and 88 in a pivotal manner within the grooves formed in the top of the arcuate minor segment 84. This is done in the manner best shown in FIG. 6 so that each arm is mounted to the arcuate minor segment 84 at a location within the groove furthest from the location to which that arm is connected to its respective first and second arcuate member 80 and 82. This results in each of the pair of interconnecting arms 86 and 88 being spatially crossed in its mounting relationship to the minor arcuate section 84 with respect to its pivotal connection to the minor arcuate segment 84 bridging the opening in the ring shank formed.

A pair of threaded grooves 120 and 122 are cut in opposite sides of the arcuate minor segment 84 and the same are located to cooperate with a pair of correspondingly located threaded grooves within a ring top 90. The ring top 90, as will be appreciated by those of ordinary skill in the art, may take any convenient form and is externally configured to have a pleasing design. The function of the ring top 90 is to provide an ornamental covering for the cutaway first and second top portions 94 and 96 of the ring shank formed by the arcuate members 80 and 82, as well as to cover the arcuate minor segment 84 and the pair of interconnecting arms 86 and 88. The threaded grooves 120 and 122 are most conveniently cut by assembling the arcuate minor segment 84 to the first and second arcuate members 80 and 82 by means of the pair of interconnecting arms 86 and 88 and then placing the ring top 90 over the resulting structure. Once this is accomplished and with the arcuate minor segment 84 held in the position shown in FIG. 4, the pair of threaded channels may be cut at the interface between the ring top 90 and the sides of the arcuate minor segment 84.

At this juncture, assembly of the exemplary embodiment of the adjustable ring structure illustrated in FIGS. 4–6 is completed by the insertion of a pair of screws 124 and 126 into the threaded channels 120 and 122 cut at the interface between the walls of the minor arcuate segment 84 and commonly positioned interior walls of the ring top 90. Once the screws 124 and 126 are thus inserted, those of ordinary skill in the art will appreciate that the ring top 90 is fixedly mounted to the arcuate minor segment 84 and is displaceable therewith.

Upon completion of the assembly of the embodiment of the adjustable ring structure illustrated in FIGS. 4–6, those of ordinary skill in the art will appreciate that the same is readily expandible by a user. Further, as the same expands the adjustable ring structure will maintain the internal portion of the ring shank in a general overall round condition to insure the comfort of the wearer while the same is generally biased by the clip springs 98 and 100 to a contracted position. The contracted position of the adjustable ring structure represented by the instant embodiment of the present invention is shown in FIG. 4, and it will be readily seen that in the contracted position the ring top 90 abuts the shoulders 128 and 130 of the cutaway portions of the first and second arcuate members 80 and 82 forming the ring shank. In this condition this embodiment of the adjustable ring structure according to the present invention provides no indication whatsoever that an adjustable structure is present.

When the ring structure is expanded, as illustrated in FIG. 5, the ring top 90 will displace from the shoulders 128 and 130 on the ring shank formed. Such displacement, however, gives no more than an appearance of a symmetrical design in the resulting ring structure so that the overall look of fine jewelery is maintained. It will also be noted that within the gap between the ring top 90 and the shoulders 130 and 128 is displayed the same metal as employed for the first and second arcuate members 80 and 82 forming the ring shank. The embodiment of the adjustable ring structure illustrated in FIGS. 4–6 will also expand to accommodate differences of about three sizes of ring. Therefore, this embodiment of the invention will readily fit a great variety of wearers and may be shifted by the wearer from finger to finger. As the ring is expanded, the overall round shape of the interior portion of the shank is maintained. Should it be desired to limit the expansion of the embodiment of the adjustable ring structure illustrated in FIGS. 4–6, appropriate stops may be inserted in the channel portions of the minor arcuate segment 84 to engage opposing portions of the pair of interconnecting arms 86 and 88 in much the same manner described in connection with the FIG. 1 embodiment of the present invention. Here, however, due to the crossing of the pair of interconnecting arms 86 and 88, expansion to a maximum position is generally achieved in a sufficiently positive manner so that the provision of such stops is unnecessary.

Although the present invention has been described in connection with several rather specific exemplary embodiments thereof, it will be understood that many modifications and variations thereto will be readily apparent to those of ordinary skill in the art. Therefore, it is manifestly intended that this invention be only limited by the claims and the equivalents thereof.

What is claimed is:

1. An adjustable ring comprising:

a ring shank, said ring shank being hinged to define first and second arcuate elements having an opening therebetween:

a minor ring segment, said minor ring segment having a pair of externally grooved sidewalls;

linkage means pivotably connecting said minor ring segment to said first and second arcuate elements at a location thereon proximate to said opening, said linkage means disposing said minor ring segment in alignment with said opening and permitting said minor ring segment to be displaced toward and away from said opening to expand and contract, respectively, said ring shank;

an ornamental ring top, said ornamental ring top being configured to fit over said minor ring segment and at least portions of said first and second arcuate elements adjacent to said opening, said ornamental ring top having a pair of internally grooved sidewalls positioned to spacially cooperate with said pair of externally grooved sidewalls in said minor ring segment to define a pair of closed channels intermediate adjacent sidewalls of said minor ring segment and said ornamental ring top, and each of said closed channels being accessible at locations beneath said minor ring segment and said ornamental ring top; and fixation means insertable in each of said pair of closed channels for frictionally engaging said ornamental ring top to said minor ring segment in a manner to permit said minor ring segment to be displaced to expand and contract said ring shank.

2. The adjustable ring according to claim 1 wherein each of said closed channels is threaded and said fixation means takes the form of screws.

3. The adjustable ring according to claim 1 wherein said portions of said first and second arcuate elements are configured to accept said ornamental ring top.

4. The adjustable ring according to claim 1 wherein said first and second arcuate elements are substantially equal in size and form respective halves of said ring shank, said first and second arcuate elements being hinged at a location opposite to said opening defined.

5. The adjustable ring according to claim 1 additionally comprising means for biasing said linkage means in a predetermined position to normally maintain said adjustable ring in a contracted condition.

* * * * *